US010598189B2

(12) United States Patent
Liu et al.

(10) Patent No.: US 10,598,189 B2
(45) Date of Patent: Mar. 24, 2020

(54) FAN, DIFFUSER, AND VACUUM CLEANER HAVING THE SAME

(71) Applicant: Johnson Electric S.A., Murten (CH)

(72) Inventors: Feng Liu, Shenzhen (CN); Chuan Hui Fang, Hong Kong (CN); Feng Xue, Shenzhen (CN); Huan He, Shenzhen (CN)

(73) Assignee: JOHNSON ELECTRIC INTERNATIONAL AG, Murten (CH)

( * ) Notice: Subject to any disclaimer, the term of this patent is extended or adjusted under 35 U.S.C. 154(b) by 534 days.

(21) Appl. No.: 15/240,295

(22) Filed: Aug. 18, 2016

(65) Prior Publication Data

US 2017/0051755 A1 Feb. 23, 2017

(30) Foreign Application Priority Data

Aug. 19, 2015 (CN) ..... 2015 1 0511134

(51) Int. Cl.
*F04D 29/44* (2006.01)
*F04D 29/28* (2006.01)
*F04D 25/08* (2006.01)

(52) U.S. Cl.
CPC ..... *F04D 29/444* (2013.01); *F04D 25/08* (2013.01); *F04D 29/281* (2013.01)

(58) Field of Classification Search
CPC ..... F04D 29/444; F04D 29/441; F04D 29/44; F04D 29/4253; F04D 29/44226; F04D 29/4206; F04D 29/42; F04D 29/281; F04D 29/428; F04D 29/30; F04D 17/06; F04D 25/08; F04D 25/06
See application file for complete search history.

(56) References Cited

U.S. PATENT DOCUMENTS 1,047,663 A * 12/1912 Lawaczeck ..... F04D 29/444 415/199.3
3,150,823 A 9/1964 Adams
3,973,872 A * 8/1976 Seleznev ..... F04D 29/444 415/208.3
2007/0122277 A1* 5/2007 Oh ..... A47L 5/22 415/211.2

(Continued)

FOREIGN PATENT DOCUMENTS

DE 20 20150100968 U1 3/2015
EP 1 878 376 A2 1/2008

(Continued)

*Primary Examiner* — Bryan M Lettman
(74) *Attorney, Agent, or Firm* — Muncy, Geissler, Olds & Lowe, PC

(57) ABSTRACT

A fan of a vacuum cleaner includes a motor, an impeller, and a diffuser. The diffuser includes a bottom plate and guide vanes disposed on the bottom plate. The guide vanes are evenly spaced and arranged along a circumferential direction of the bottom plate. Each guide vane extends obliquely from an inner edge to an outer edge of the bottom plate. An outer end of each guide vane extends beyond the outer edge of the bottom plate. Each guide vane is deflected an angle of 30 to 70 degrees with respect to a tangential direction of the bottom plate at the inner end of the guide vane. The outer end of each guide vane is deflected an angle of 35 to 120 degrees along a circumferential direction with respect to the inner end of the guide vane.

20 Claims, 9 Drawing Sheets

(56) References Cited

U.S. PATENT DOCUMENTS

| | | | | |
|---|---|---|---|---|
| 2007/0241644 | A1* | 10/2007 | Kakugawa | H02K 1/187 310/67 R |
| 2008/0014080 | A1* | 1/2008 | Fang | A47L 5/22 415/191 |
| 2011/0020152 | A1* | 1/2011 | Ising | F02B 37/013 417/406 |
| 2012/0237373 | A1* | 9/2012 | Li | F04D 25/0606 417/410.1 |
| 2014/0294630 | A1* | 10/2014 | Oh | F04D 13/06 417/420 |

FOREIGN PATENT DOCUMENTS

| | | | |
|---|---|---|---|
| WO | WO 97/19629 | A1 | 6/1997 |
| WO | WO 2014/177846 | A1 | 11/2014 |

* cited by examiner

FAN, DIFFUSER, AND VACUUM CLEANER HAVING THE SAME

CROSS REFERENCE TO RELATED APPLICATIONS

This non-provisional patent application claims priority under 35 U.S.C. § 119(a) from Patent Application No. 201510511134.4 filed in The People's Republic of China on 19 Aug. 2015.

FIELD OF THE INVENTION

The present invention relates to vacuum cleaners, and in particular to a fan of the vacuum cleaner and a diffuser for the fan.

BACKGROUND OF THE INVENTION

In a vacuum cleaner, high speed rotation of a fan exhausts internal air to establish a pressure difference between inside and outside of the vacuum cleaner, which continuously draws the air around an air suction port into the fan and, at the same time, draws and collects rubbish such as dusts and debris around the air suction port.

Typically, the fan of the vacuum cleaner includes a motor, an impeller and a diffuser. The impeller is connected to the motor, the diffuser surrounds the impeller, the motor drives the impeller to rotate to generate a high pressure airflow, and the diffuser guides the airflow to be quickly exhausted out of the motor. Structure of the diffuser affects velocity distribution and flow rate of the airflow. Therefore, there is a desire for a high efficiency diffuser which can effectively increase the flow rate of the fan and reduce the power consumption.

SUMMARY OF THE INVENTION

Accordingly, a high efficient diffuser, a fan, and a vacuum cleaner having the same are provided.

In one aspect, a diffuser is provided which includes a bottom plate and a plurality of guide vanes disposed on the bottom plate. The bottom plate is annular in shape. The guide vanes are evenly spaced and arranged along a circumferential direction of the bottom plate. Each of the guide vanes extends obliquely from an inner edge to an outer edge of the bottom plate. An outer end of each guide vane extends outward beyond the outer edge of the bottom plate. Each guide vane is deflected an angle of 30 to 70 degrees with respect to a tangential direction of the bottom plate at an inner end of the guide vane. The outer end of each guide vane is deflected an angle of 35 to 120 degrees along a circumferential direction with respect to the inner end of the guide vane.

In another aspect, a fan is provided which includes a motor, an impeller, and a diffuser. The motor includes a rotary shaft. The impeller is coupled to the rotary shaft for rotating with the motor. The diffuser includes a bottom plate and a plurality of guide vanes disposed on the bottom plate. The bottom plate is annular in shape. The guide vanes are evenly spaced and arranged along a circumferential direction of the bottom plate. Each of the guide vanes extends obliquely from an inner edge to an outer edge of the bottom plate. An inner end of the guide vane is disposed outside an inner edge of the bottom plate in a radial direction. An outer end of each guide vane extends outward beyond the outer edge of the bottom plate. Each guide vane is deflected an angle of 30 to 70 degrees with respect to a tangential direction of the bottom plate at the inner end of the guide vane. The outer end of each guide vane is deflected an angle of 35 to 120 degrees along a circumferential direction with respect to the inner end of the guide vane.

In another aspect, a vacuum cleaner is provided which includes a fan, the fan includes a motor, an impeller, and a diffuser. The motor includes a rotary shaft. The impeller is coupled to the rotary shaft for rotating with the motor. The diffuser includes a bottom plate and a plurality of guide vanes disposed on the bottom plate. The bottom plate is annular in shape. The guide vanes are evenly spaced and arranged along a circumferential direction of the bottom plate. Each of the guide vanes extends obliquely from an inner edge to an outer edge of the bottom plate. An inner end of the guide vane is disposed outside an inner edge of the bottom plate in a radial direction. An outer end of each guide vane extends outward beyond the outer edge of the bottom plate. Each guide vane is deflected an angle of 30 to 70 degrees with respect to a tangential direction of the bottom plate at the inner end of the guide vane. The outer end of each guide vane is deflected an angle of 35 to 120 degrees along a circumferential direction with respect to the inner end of the guide vane.

In comparison with the prior art, the fan of the vacuum cleaner includes a diffuser with deflected guide vanes, which can better guide the airflow, increase the pressure of the airflow, effectively enhance the efficiency of the fan, and reduce the power consumption.

DETAILED DESCRIPTION OF THE PREFERRED EMBODIMENTS

Figure 1:
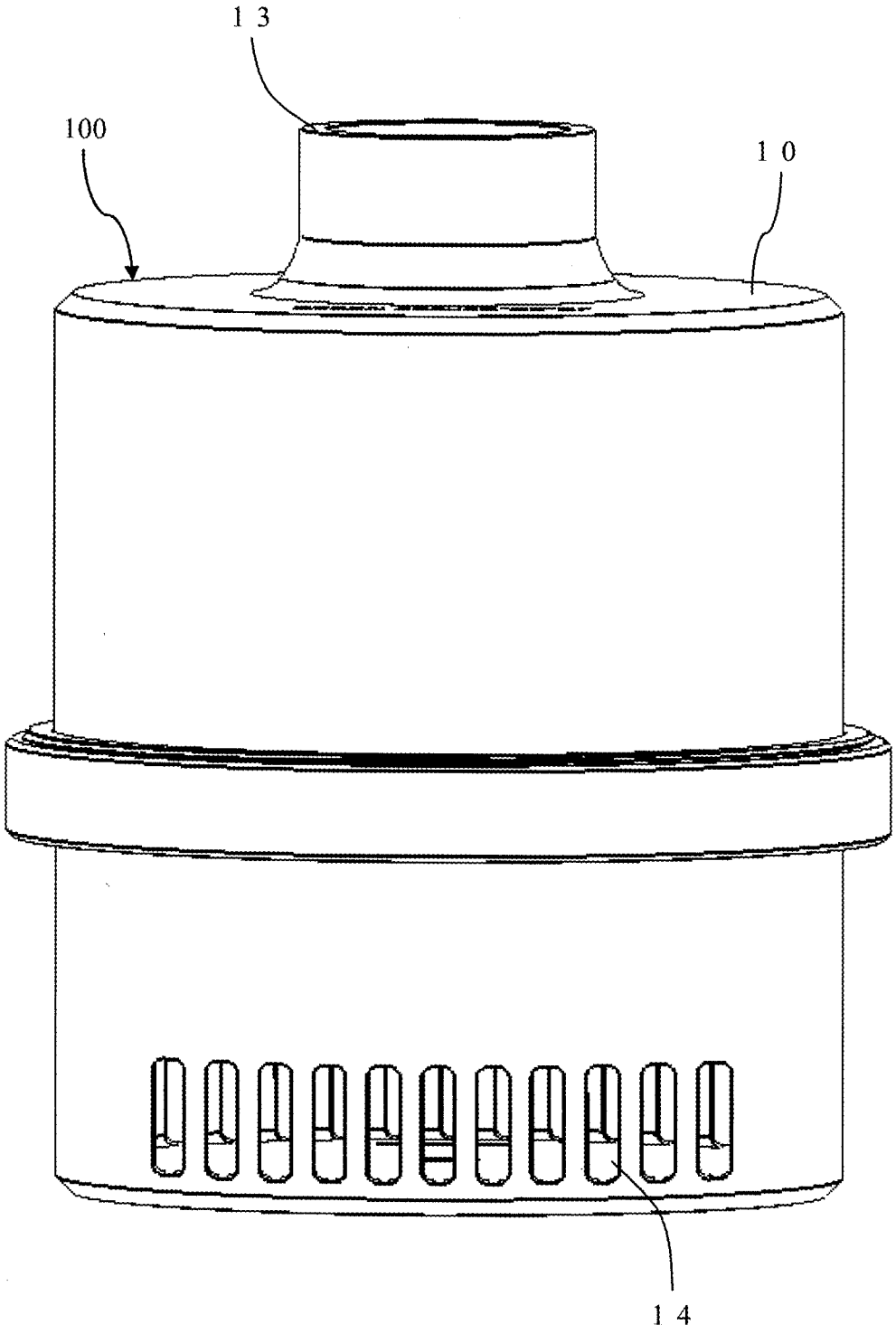
FIG. 1 is a perspective view of a fan of an embodiment of the invention.
Figure 2:
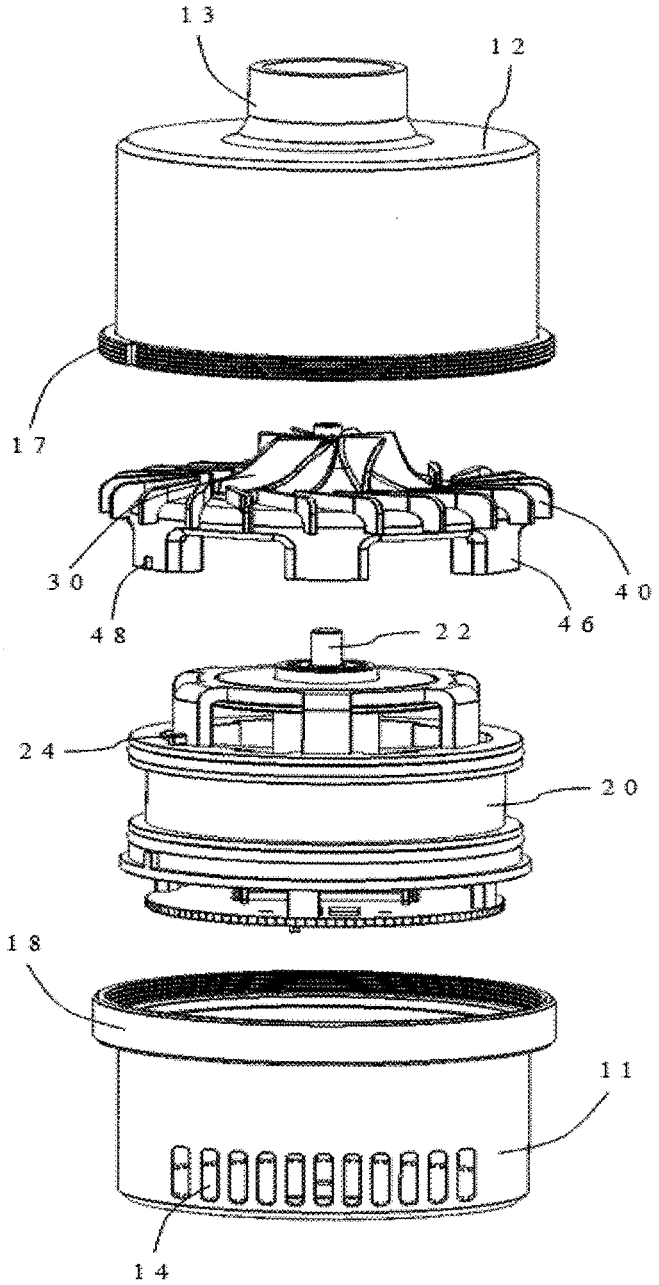
FIG. 2 is an exploded view of FIG. 1, wherein the fan includes an impeller and a diffuser.

Referring to FIG. 1 and FIG. 2, a fan 100 in accordance with one embodiment of the present invention includes an outer housing 10, a motor 20, an impeller 30 and a diffuser 40 received in the outer housing 10.

Figure 3:
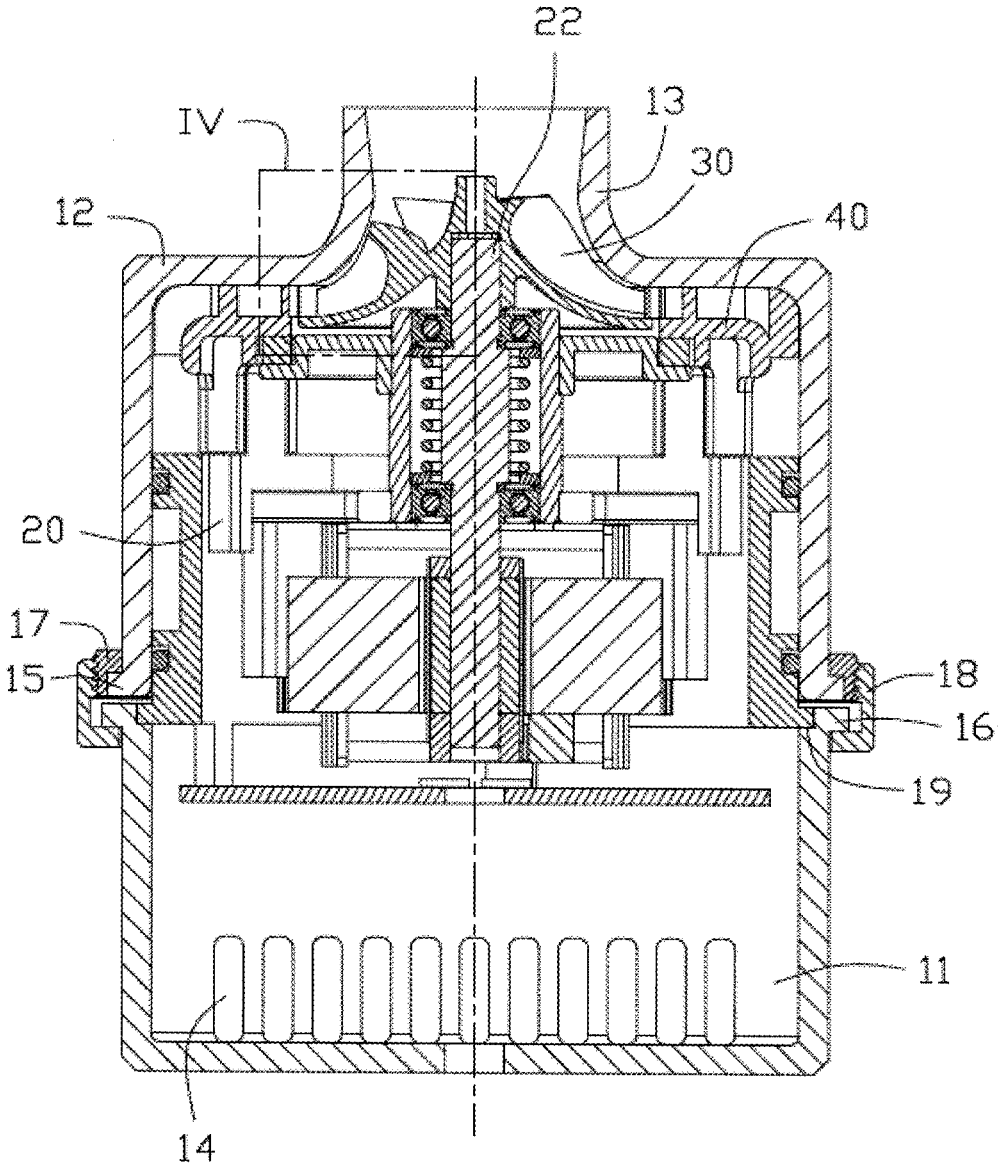
FIG. 3 is a cross sectional view of FIG. 2.
Figure 9:
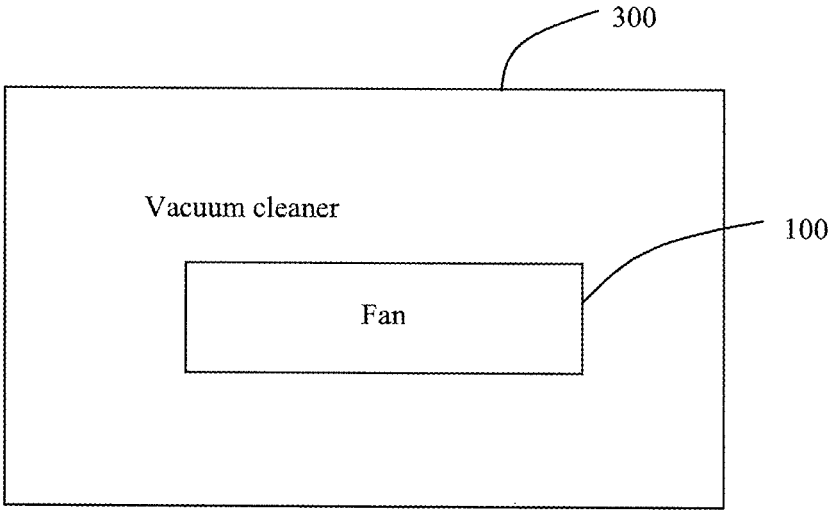
FIG. 9 illustrates the fan of FIG. 1 used in a vacuum cleaner.

Referring to FIG. 2, FIG. 3 and FIG. 9, the outer housing 10 is cylindrical in shape, including a bottom base 11 and a top cover 12 connected to the bottom base 11. An air suction port 13 is defined in a center of a top plate of the top cover 12, for drawing air around a suction mouth of a vacuum cleaner 300 into the fan 100. A sidewall of the bottom base 11 defines a plurality of air outlet ports 14 for exhausting the air in the fan 100 out of the fan 100. Interconnected ends of the bottom base 11 and the top cover 12, i.e. a top end of the bottom base 11 and a bottom end of the top cover 12, protrude radially outward to form flanges 15 and 16, respectively. A locking ring 17 is attached around the flange 15 of the top cover 12. A top end of the locking ring 17 protrudes radially inward to form an annular flange which is overlappingly disposed on the flange 15 of the top cover 12. External threads is formed on an outer surface of the locking ring 17. A nut 18 is attached around the flange 16 of the bottom base 11. A bottom end of the nut 18 protrudes radially inward to form another annular flange which is overlappingly disposed below the flange 16 of the bottom base 11. In assembly, the nut 18 is screwed to the locking ring 17 to fixedly connect the top cover 12 to the bottom base 11.

The motor 20 is received in the outer housing 10. In this embodiment, a step 19 is formed on an inner wall surface of the top end of the bottom base 11, and the motor 20 is disposed on the step 19. Preferably, the motor 20 is an inner rotor single-phase direct current brushless motor 20, which includes a central rotary shaft 22. A top end of the rotary shaft 22 extends upward to the air suction port 13 to connect to the impeller 30 and drive the impeller 30 for synchronous rotation therewith.

Figure 4:
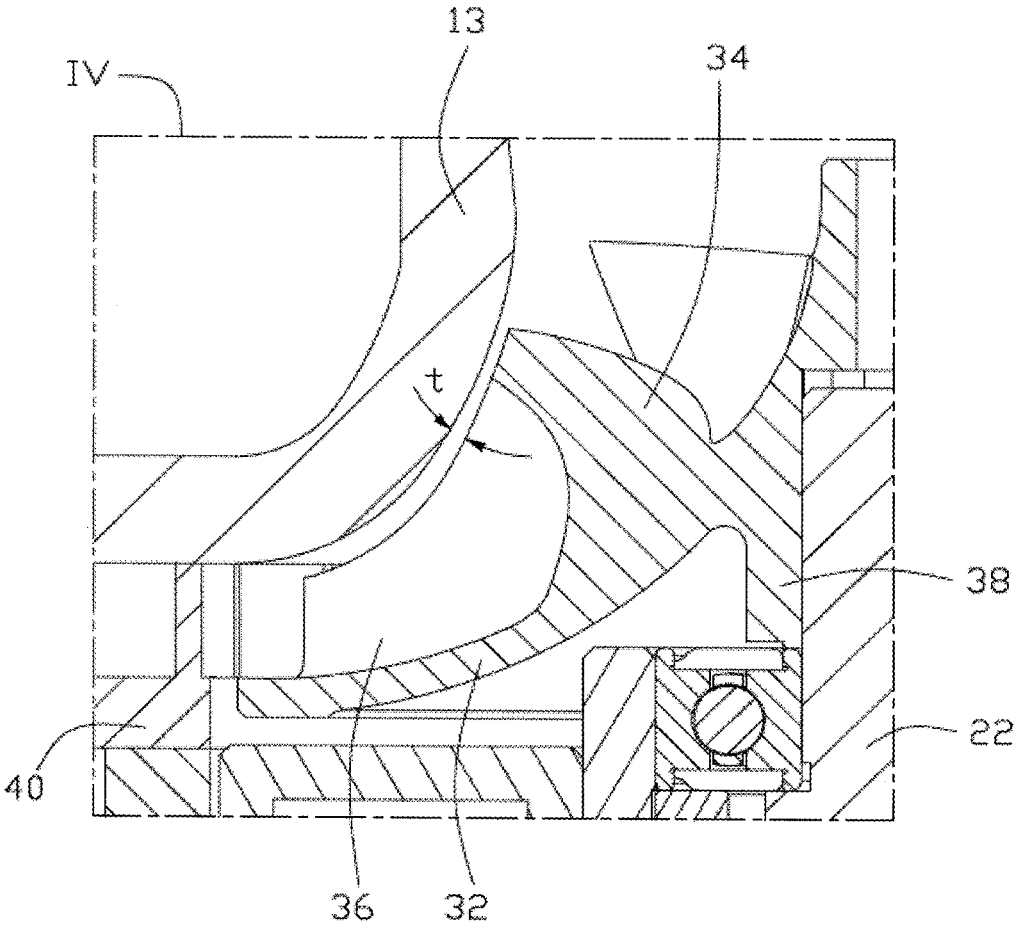
FIG. 4 is an enlarged view of the framed portion IV of FIG. 3.
Figure 5:
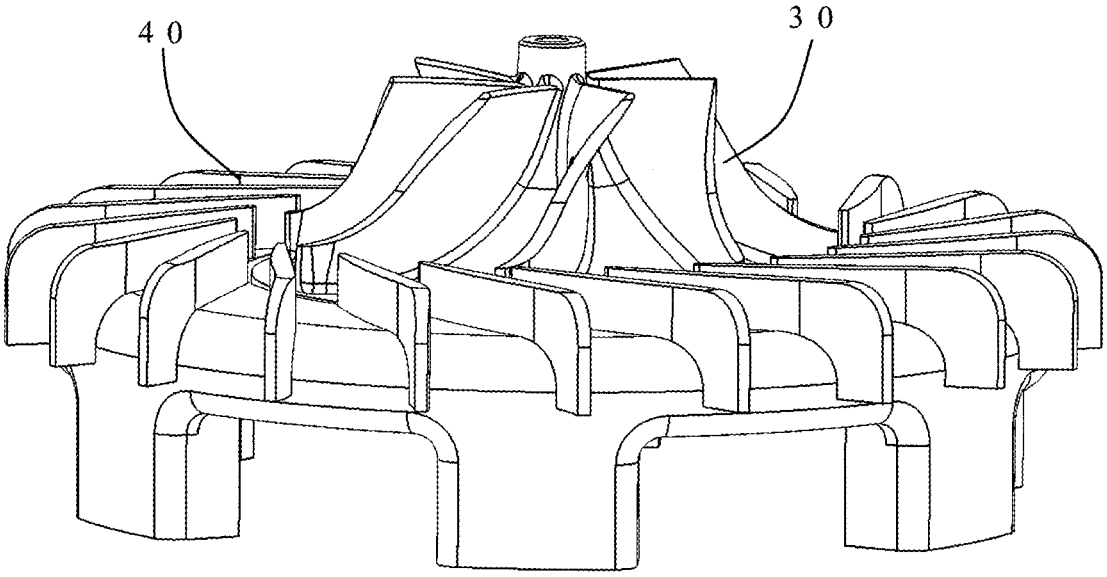
FIG. 5 is an enlarged, assembled view of the impeller and diffuser of FIG. 2 from another aspect.
Figure 6:
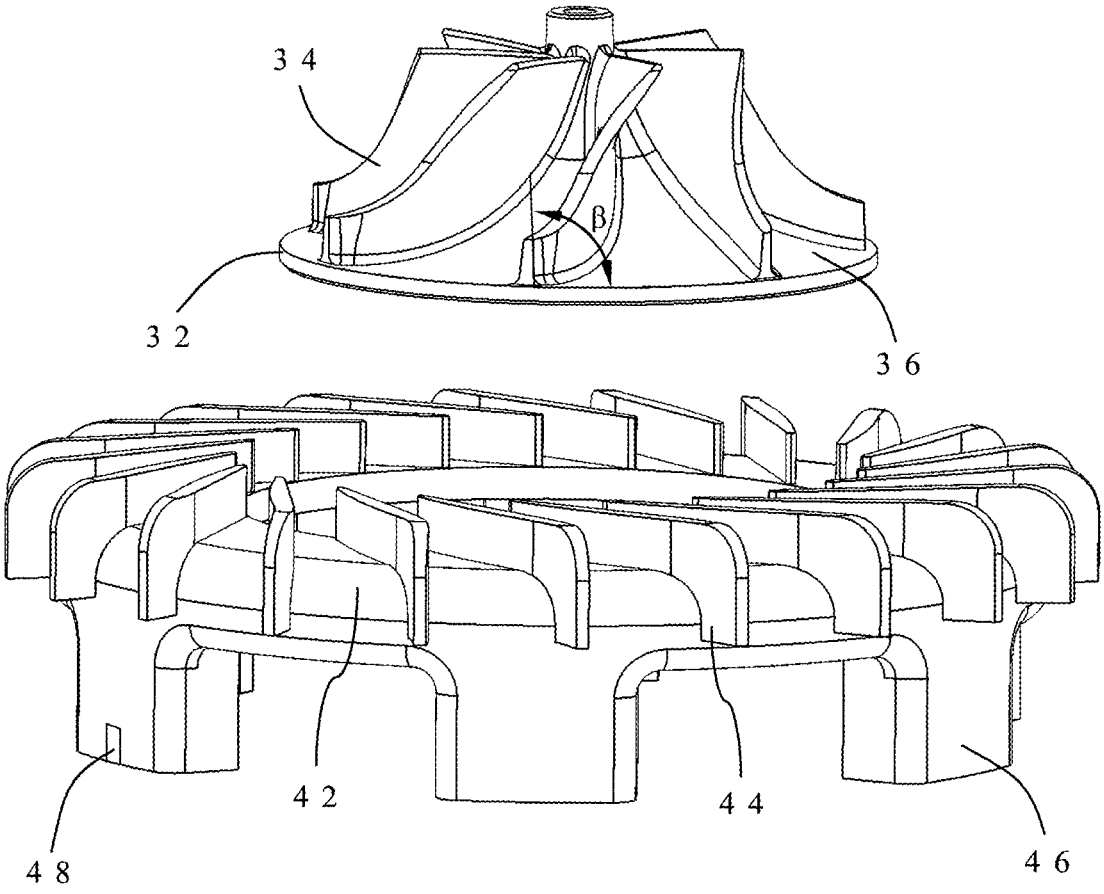
FIG. 6 is an exploded view of FIG. 5.

Referring also to FIG. 5 and FIG. 6, the impeller 30 includes a substantially trumpet-shaped base plate 32 and a plurality of blades 34 formed on the base plate 32. An outer wall surface 36 of the base plate 32 is a trumpet-shaped concave arc-surface, which extends axially from top to bottom to from a gradually expanding shape with its outer diameter gradually increasing, a cross-section of which taken along the axial direction is in the form of the Chinese character "A". A shaft support 38 (FIG. 3 and FIG. 4) extends axially and downwardly from an inner wall surface of the base plate 32, and the top end of the rotary shaft 22 is pivotably connected within the shaft support 38. Preferably, an inner diameter of the shaft support 38 is equal to or slightly less than a diameter of the rotary shaft 22, such that the rotary shaft 22 and the shaft support 38 are fixedly connected by interference-fit for synchronous rotation. The blades 34 are integrally formed on the outer wall surface 36 of the base plate 32 of the impeller 30, and are evenly spaced and arranged along a circumferential direction of the impeller 30, with flow passages formed between every two adjacent blades 34. Upon rotation of the impeller 30, air flows outwards through the flow passages between the blades 34 and is pressurized into high pressure airflow during the flow of the air.

Figure 7:
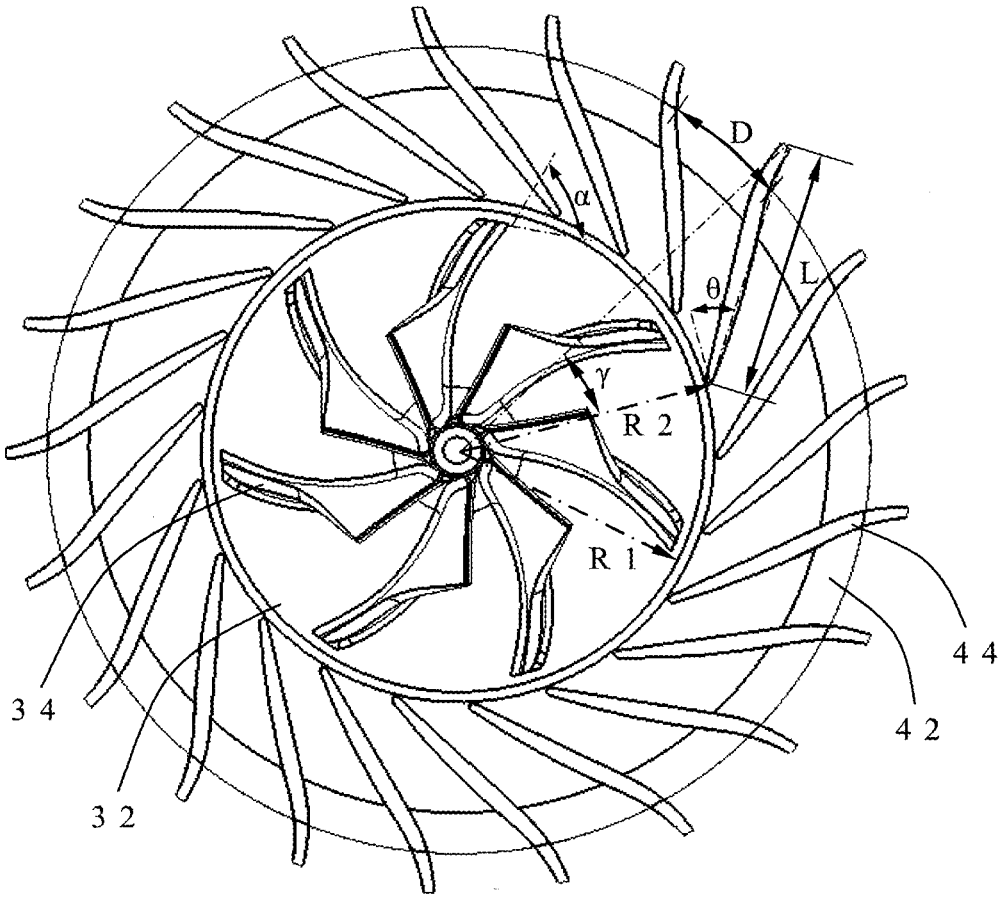
FIG. 7 is a top view of FIG. 5.

Referring also to FIG. 7, each blade 34 extends in a twisted form, which is curved in both radial and axial directions. An inner end of the blade 34 is disposed adjacent an inner edge of the outer wall surface 36 of the base plate 32, and an outer end of the blade 34 is disposed within an outer edge of the outer wall surface 36 of the base plate 32, with a small distance spaced between the outer end of the blade 34 and the inner edge of the outer wall surface 36. The outer end of the blade 34 is deflected an angle along a clockwise direction with respect to the inner end of the blade 34. An angle $\alpha$ formed between a tangential direction of the outer end of the blade 34 and a tangential direction of a portion of the base plate 32 at the outer end of the blade 34 is an acute angle, preferably in the range of 40 to 70 degrees. The outer end of the blade 34 is inclined with respect to a plane perpendicular to the axial direction of the blade, with an angle $\beta$ (referring to FIG. 6) formed therebetween. The angle $\beta$ is preferably in the range of 65 to 90 degrees. This not only makes it possible to effectively pressurize the airflow through the blades 34, but it also causes the airflow to exit the outer ends of the blades 34 at an angle.

Referring also to FIG. 4, in order to ensure the pressurizing effect to the airflow while permitting free rotation of the impeller 30, an inner surface of the air suction portion 13 of the outer housing 10 matches with the impeller 30 in shape, which has a gradually expanding shape from up to down. The inner surface of the air suction portion 13 and the blades 34 of the impeller 30 form a narrow gap t therebetween. Preferably, the gap t is not greater than 0.5 mm.

Referring also to FIG. 3, FIG. 5, FIG. 6 and FIG. 7, the diffuser 40 is disposed on the motor 20, surrounding the impeller 30. The diffuser 40 includes a bottom plate 42 and a plurality of guide vanes 44 disposed on the bottom plate 42.

The bottom plate 42 is annular in shape, which has an inner diameter R2 slightly greater than a maximum outer diameter R1 of the base plate 32 of the impeller 30, such that the impeller 30 can freely rotate in the diffuser 40. Preferably, a ratio of the inner diameter R2 of the bottom plate 42 to the outer diameter R1 of the impeller 30, R2/R1 is in the range of about 1.05 to 1.40. Preferably, the outer edge of the base plate 32 is arc-chamfered for facilitating exhausting of the airflow. A plurality of positioning blocks 46 protrudes axially and downwardly from an outer edge of the bottom plate 42. In this embodiment, the positioning block 46 has a substantially U-shaped cross-section, and each positioning block 46 is placed around a corresponding one of columns of the motor 20, such that the diffuser 40 is circumferentially positioned and cannot rotate. Preferably, one positioning block 46 defines a locking hole 48, and one of the columns of the motor 20 forms a protrusion 24 (referring to FIG. 2), which together form a foolproof mechanism. In assembly, by engaging the locking hole 48 with the protrusion 24, the impeller 30 can be correctly assembled to the motor 20.

Referring to FIG. 6 and FIG. 7, the guide vanes 44 are integrally coupled to an upper surface of the bottom plate 42, which have a number far greater than the number of the blades 34 of the impeller 30. Preferably, the number of the guide vanes 44 is in the range of 18 to 35, and the guide vanes 44 are evenly distributed along a circumferential direction of the bottom plate 42, with a circumferential gap formed between each two adjacent guide vanes 44. Each guide vane 44 is approximately perpendicular to the upper surface of the bottom plate 42, and extends obliquely from inside to outside. An outer end of the guide vane 44 is deflected an angle $\alpha$ with respect to an inner end of the guide vane 44 along an anticlockwise direction. Preferably, the angle $\alpha$ is in the range of 35 to 120 degrees. The guide vane 44 deviates from a tangential direction of the bottom plate 42 at the inner end thereof by an angle $\theta$. Preferably, the angle $\theta$ is in the range of 30 to 70 degrees.

The inner end of the guide vane 44 is close to or spaced a small distance from an inner edge of the upper surface of the bottom plate 42, and the outer end of the guide vane 44 extends a distance beyond the outer edge of the upper surface of the bottom plate 42. Preferably, a length L of each guide vane 44, i.e. the distance between the inner end and outer end of the guide vane 44, is no less than an arc length D of the outer edge of the bottom plate 42 between two adjacent guide vanes 44. Preferably, a ratio of the length L of the guide vane 44 to the arc length D, i.e. L/D, is in the range of about 1.0 to 2.8.

Figure 8:
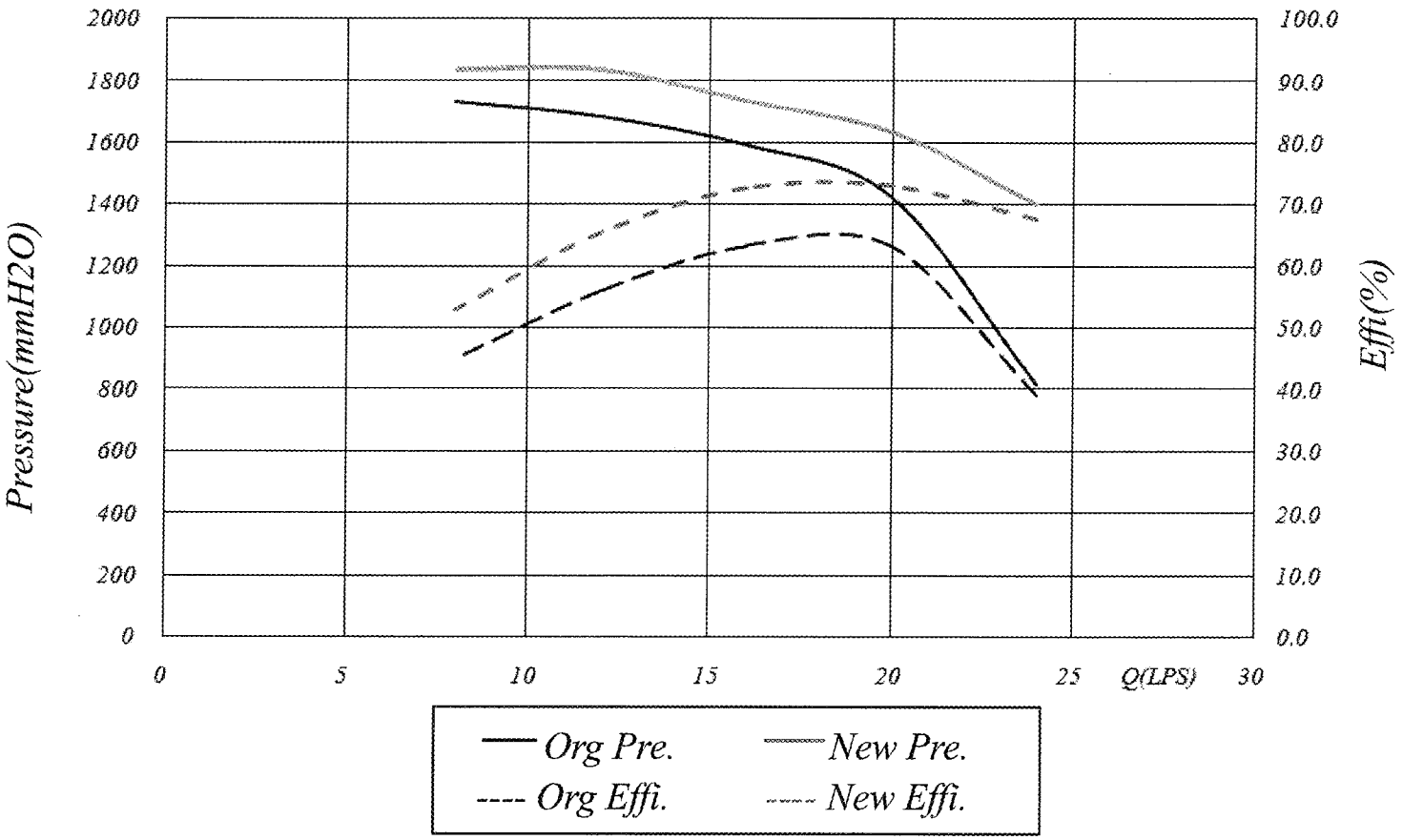
FIG. 8 is a diagram showing comparison of the efficacy between the present fan and a conventional fan.

When the motor 20 drives the impeller 30 to rotate, air is driven to flow. After pressurized, the air flows out via the outer ends of the blades 34 of the impeller 30 and into gaps between the guide vanes 44 of the diffuser 40. Appropriate guide by the diffuser 40 reduces the turbulence loss of the airflow, and the gradually expanding passage area of the diffuser 40 causes part of the kinetic energy of the airflow to be converted into static pressure energy and therefore reduces the dynamic pressure loss at the outlet of the diffuser 40, thereby increasing the static pressure and efficiency of the entire fan system. When the air exits from the outer edge of the diffuser 40, the pressure of the air is further increased, which results in a high pressure airflow delivered to the motor 20 to take the heat of the motor 20 away and finally exhausted out of the fan 100 via the air outlet ports 14 of the outer housing 10, thereby effectively enhancing the efficiency of the fan and reducing the power consumption. As shown in FIG. 8, the winding pressure and efficiency of the fan of the present invention are both increased by about 10% in comparison with the conventional fan of a vacuum cleaner.

The fan 100 of the present invention is particularly suitable for use in high rotation speed electrical devices such as vacuum cleaners 300, hand dryers or blowers.

Although the invention is described with reference to one or more preferred embodiments, it should be appreciated by those skilled in the art that various modifications are possible. Therefore, the scope of the invention is to be determined by reference to the claims that follow.

The invention claimed is:

1. A diffuser for a vacuum cleaner comprising:

a bottom plate being annular in shape; and a plurality of guide vanes disposed on the bottom plate, the guide vanes being evenly spaced and arranged along a circumferential direction of the bottom plate, each of the guide vanes extending obliquely from an inner edge to an outer edge of the bottom plate, an outer end of each guide vane extending outward beyond the outer edge of the bottom plate, each guide vane being deflected an angle of 30 to 70 degrees with respect to a tangential direction of the bottom plate at an inner end of the guide vane, the outer end of each guide vane being deflected an angle of 35 to 120 degrees along a circumferential direction with respect to the inner end of the guide vane, wherein a passage area between each two adjacent guide vanes gradually expand from an inlet to an outlet of the diffuser.

2. The diffuser of claim 1, wherein the inner end of each guide vane is adjacent to the inner edge of the bottom plate.

3. The diffuser of claim 1, wherein a ratio of a length of each guide vane to an arc length of the outer edge of the bottom plate between two adjacent guide vanes is in a range of 1.0 to 2.8.

4. The diffuser of claim 1, wherein each guide vane extends axially and is perpendicular to the bottom plate.

5. The diffuser of claim 1, wherein the guide vanes are located on a same surface of the bottom plate, and a number of the guide vanes is in a range of 18 to 35.

6. A fan for a vacuum cleaner comprising:

a motor comprising a rotary shaft;

an impeller coupled to the rotary shaft for rotating with the motor; and a diffuser surrounding the impeller, the diffuser comprising:

a bottom plate being annular in shape; and a plurality of guide vanes disposed on the bottom plate, the guide vanes being evenly spaced and arranged along a circumferential direction of the bottom plate, each of the guide vanes extending obliquely from an inner edge to an outer edge of the bottom plate, an outer end of each guide vane extending outward beyond the outer edge of the bottom plate, each guide vane being deflected an angle of 30 to 70 degrees with respect to a tangential direction of the bottom plate at an inner end of the guide vane, the outer end of each guide vane being deflected an angle of 35 to 120 degrees along a circumferential direction with respect to the inner end of the guide vane, wherein a passage area between each two adjacent guide vanes gradually expand from an inlet to an outlet of the diffuser.

7. The fan of claim 6, wherein the impeller comprises a base plate and a plurality of blades formed on the base plate, the base plate is substantially trumpet-shaped, a shaft support extends axially from an inner wall surface of the base plate, the rotary shaft of the motor rotates together with the shaft support, an outer wall surface of the base plate is a concave arc-surface, the blades are formed on the outer wall surface, and an outer end of each of the blades is located at an inside of the outer edge of the base plate in a radial direction.

8. The fan of claim 7, wherein a tangential direction of the outer end of the blade and a tangential direction of a portion of the base plate at the outer end of the blade form therebetween an angle of 40 to 70 degrees.

9. The fan of claim 6, wherein a ratio of an inner diameter of the bottom plate to an outer diameter of the impeller is in a range of 1.05 to 1.40.

10. The fan of claim 6, wherein the impeller comprises a plurality of blades, an outer end of the blade is inclined with respect to a plane perpendicular to the axial direction of the blade by an angle in a range of 65 to 90 degrees.

11. The fan of claim 6, wherein the impeller comprises a plurality of blades, an outer end of the blade is deflected an angle with respect to an inner end of the blade, and a direction of deflection of the outer end of the blade with respect to the inner end of the blade is opposite to a direction of deflection of the outer end of the guide vane of the diffuser with respect to the inner end of the guide vane.

12. The fan of claim 6, wherein the impeller comprises a plurality of blades, the fan further comprises an outer housing in which the motor, impeller and diffuser are received, the outer housing forms an air suction port at one end thereof and air outlet ports at another end thereof, the impeller and diffuser are disposed at the air suction port, and the blades of the impeller and an inner surface of the air suction port form therebetween a gap greater than 0 and not greater than 0.5 mm.

13. The fan of claim 6, wherein the motor is a single phase direct current brushless motor and has a rotation speed 120,000 revolutions per minute (rpm).

14. The fan of claim 6, wherein the inner end of each guide vane is adjacent to the inner edge of the bottom plate.

15. The fan of claim 6, wherein a ratio of a length of each guide vane to an arc length of the outer edge of the bottom plate between two adjacent guide vanes is in a range of 1.0 to 2.8.

16. The fan of claim 6, wherein each guide vane extends axially and is perpendicular to the bottom plate.

17. The fan of claim 6, wherein the guide vanes are located on a same surface of the bottom plate, and a number of the guide vanes is in a range of 18 to 35.

18. A vacuum cleaner comprising a fan, the fan comprising:

a motor comprising a rotary shaft;

an impeller coupled to the rotary shaft for rotating with the motor; and a diffuser surrounding the impeller, the diffuser comprising:

a bottom plate being annular in shape; and a plurality of guide vanes disposed on the bottom plate, the guide vanes being evenly spaced and arranged along a circumferential direction of the bottom plate, each of the guide vanes extending obliquely from an inner edge to an outer edge of the bottom plate, an outer end of each guide vane extending outward beyond the outer edge of the bottom plate, each guide vane being deflected an angle of 30 to 70 degrees with respect to a tangential direction of the bottom plate at an inner end of the guide vane, the outer end of each guide vane being deflected an angle of 35 to 120 degrees along a circumferential direction with respect to the inner end of the guide vane, wherein a passage area between each two adjacent guide vanes gradually expand from an inlet to an outlet of the diffuser.

19. The vacuum cleaner of claim 18, wherein the impeller comprises a base plate and a plurality of blades formed on the base plate, the base plate is substantially trumpet-shaped, a shaft support extends axially from an inner wall surface of the base, the rotary shaft of the motor rotates together with the shaft support, an outer wall surface of the base plate is a concave arc-surface, the blades are formed on the outer wall surface, and an outer end of each of the blades is located at an inside of the outer edge of the base plate in a radial direction.

20. The vacuum cleaner of claim 18, wherein a ratio of a length of each guide vane to an arc length of the outer edge of the bottom plate between two adjacent guide vanes is in a range of 1.0 to 2.8.

* * * * *